US005815078A

United States Patent [19]

Mun et al.

[11] Patent Number: 5,815,078

[45] Date of Patent: Sep. 29, 1998

[54] LOUVER DRIVING DEVICE FOR AN AIR CONDITIONER AND METHOD OF CONTROLLING THE LOUVER DRIVING DEVICE

[75] Inventors: Joong-Ki Mun, Seoul; Nam-Sick Kim, Yongin, both of Rep. of Korea

[73] Assignee: Samsung Electronics Co., Ltd., Suwon, Rep. of Korea

[21] Appl. No.: 820,770

[22] Filed: Mar. 18, 1997

[30] Foreign Application Priority Data

Aug. 2, 1996 [KR] Rep. of Korea ..... 1996-32394

[51] Int. Cl.[6] ..... G08B 23/00

[52] U.S. Cl. ..... 340/573; 236/49.3; 236/51

[58] Field of Search ..... 340/573; 160/1, 160/84.02; 236/49.3, 44 C, 51; 62/180, 186, 262; 454/208, 258, 285, 315, 202; 251/129.12

[56] References Cited

U.S. PATENT DOCUMENTS 4,671,458 6/1987 Fukuda et al. ..... 236/49.3
5,180,333 1/1993 Shyu ..... 236/49.3
5,251,814 10/1993 Warashina et al. ..... 236/49.3
5,331,825 7/1994 Kim ..... 236/51
5,478,276 12/1995 Lee ..... 236/51

*Primary Examiner*—Jeffery A. Hofsass
*Assistant Examiner*—John Tweel, Jr.
*Attorney, Agent, or Firm*—Burns, Doane, Swecker & Mathis, L.L.P.

[57] ABSTRACT

A louver driving device for an air-conditioner is disclosed. The air-conditioner has a main body for intaking and heat-exchanging the indoor air of a room, and for furnishing the heat-exchanged air to the room, and louvers for controlling the airflow in a direction of up and down/right and left. The inventive louver driving device includes a plurality of human body sensors for monitoring the presence of a human body in the room; human body position detecting sections that each receive output signals from the human body sensors, and detect a human body's horizontal location and vertical distance from the air-conditioner; louver driving sections for operating the louvers so as to provide heat-exchanged air towards the human body; and a microcomputer that receives a detecting signal from the human body position detecting sections and produces a control signal to the louver driving sections.

8 Claims, 10 Drawing Sheets

LOUVER DRIVING DEVICE FOR AN AIR CONDITIONER AND METHOD OF CONTROLLING THE LOUVER DRIVING DEVICE

FIELD OF THE INVENTION

The present invention relates to a louver driving device for an air-conditioner and a method of controlling the louver driving device. More particularly, it relates to a louver driving device for an air-conditioner which has the capability of automatically directing the flow of cool air towards the occupants of a room by detecting the respective positions in the room.

BACKGROUND OF THE INVENTION

The following description concerns traditional techniques related to the present invention.

Japanese Patent Unexamined Publication No. 1993-240488 (filed on Sep. 7, 1993) discloses an air conditioning system in which an infrared sensor uses a human organism tracking mechanism to scan an entire room which it partitions into zones. A control portion controls the airflow in response to the output signal of the infrared sensor, calculates the temperature difference between any two adjacent zones, and determines whether a detected heat source is in fact a human body.

Japanese Patent Unexamined Publication No. 1993-149791 (filed on Jun. 15, 1993) discloses an indoor environmental information detecting apparatus which allows an air conditioner to perform comfortable air conditioning by calculating the volume of a room, angles of the room and wall temperatures.

Japanese Patent Unexamined Publication No. 1990-143047 (filed on Jun. 1, 1990) discloses a system of performing more comfortable air conditioning by setting a human body detection zone to a human body's floor surface when a difference between the temperature of the floor surface adjacent to the human body detecting zone and the room temperature exceeds a reference value.

Korean Patent Unexamined Publication No. 1995-25366 (filed on Sep. 15, 1995) discloses a system wherein air conditioning is automatically directed towards a human's location by using a distance sensor that scans the room to be air conditioned so as to determine if a human body is present.

A conventional air-conditioner and its louver driving system will now be described with reference to the attached drawings.

As shown in FIG. 6, the louver driving system of the conventional air-conditioner includes a function selecting section 200 by which an air conditioning type and the airflow are selected, an elevational louver position detecting section 300 for detecting the driving position of the louver that controls the air flow's vertical vector, and a horizontal louver position detecting section 400 for detecting the driving position of the louver that controls the air flow's horizontal vector. The louver driving device also includes an elevational louver driving section 500 for driving the elevational louver, a horizontal louver driving section 600 for driving the horizontal louver, a human body detecting section 700 consisting of a plurality of human body sensors for detecting the location of a human body in a room to be air-conditioned, and a microcomputer 100 which controls the louver driving sections in response to the output signals from the human body sensors.

The following description relates to the operation of the conventional air-conditioner and its louver driving system.

The common-type air-conditioner includes a compressor, a condenser, a capillary tube, an evaporator, and a refrigerant pipe. The air-conditioner lowers the temperature and reduces the humidity of air in a room by absorbing warm air in the room or raises the temperature of a room by emitting warm air into the room. The latter is performed by reversing the refrigerant's phase. An intake grill provided to one side of the air-conditioner's main body suctions the relatively warm indoor air, and a cool air outlet, provided above or below the intake grill, blows air cooled by refrigerant passing through the evaporator into the room. An indoor fan installed within the main body circulates the air to and from the air-conditioner.

A wind direction control louver, rotatably installed in the cool air outlet, controls the flow of the cool air. This wind-direction control louver includes an elevational louver which directs the cool air upward or downward thereby altering the distance it is projected, and a horizontal louver for directing the cool air right or left. The elevational louver and the horizontal louver control are respectively controlled by an elevational motor and a horizontal motor.

As shown in FIG. 7, once a plurality of sensors A1, A2, B1, B2, C1 and C2 senses the presence of a human body, a control circuit 140 rotates the louver 130 to direct the flow of cool air.

As shown in FIG. 6, the louver driving system of the conventional air-conditioner includes a function selecting section 200 by which an air conditioning type and the airflow are selected, an elevational louver position detecting section 300 for detecting the driving position of the louver that controls the air flow's vertical vector, and a horizontal louver position detecting section 400 for detecting the driving position of the louver that controls the air flow's horizontal vector.

Referring to FIG. 6, the human body detecting section 700 includes a plurality of human body sensors 710 to 760. Each of these human body sensors is composed of an infrared sensor installed on one side of the air-conditioner' main body in a horizontal or vertical orientation.

FIGS. 8 and 9 show a horizontal zone detecting section's detecting zone and a proximity detecting section's detecting zone, respectively. Six human body sensors of the human body detecting section 700 are installed on one side of the main body 110 of the air-conditioner so as to sense a human body present in a space that is divided into six zones vertically and horizontally.

The six human body sensors 120 sense horizontal zones of detection, namely, right, center and left, and they determine if the distance between a human body 160 and the main body 110 of the air-conditioner is long (I) or short (II). The integration of these results in the room being divided into six three-dimensional zones. The presence of a human body in these zones results in the horizontal louver and the elevational louver being manipulated accordingly. When the human body sensor 120 detects that the human body 160 is located within a left short-distance zone (Left, II), the horizontal louver is set to the left, and the elevational louver is driven downward so that cooled air is directed at the human body 160.

In the above-described conventional air-conditioner, the vertical space of a room to be air conditioned is divided by the human body sensor according to the air-conditioner, location with respect to the vertical direction, the human body sensor may misjudge the location of the human body, which causes the erroneous operation of the elevational louver, thus decreasing the efficiency of the air conditioning and the precision.

In the case where a room to be air conditioned is divided into a plurality of zones for the purpose of controlling air conditioning properly, human body sensors have conventionally been installed for each zone of the room, thereby increasing the production costs.

SUMMARY OF THE INVENTION

The present invention eliminates the above-mentioned problems of the conventional art by introducing a louver driving device for an air-conditioner and a method of controlling the louver driving device.

The first objective of the present invention is to provide a louver driving device for an air-conditioner and a method of controlling the louver driving device whereby a human body's location is precisely determined in order to facilitate the control of an elevational louver and a horizontal louver appropriately.

The second objective of the present invention is to provide a louver driving device for an air-conditioner using human body sensors whose number is relatively smaller than that of the divided zones of a room to be air conditioned, and a method of controlling the louver driving device.

In order to achieve the above objectives and advantages, and in accordance with the purpose of the present invention as embodied and broadly described, the present invention relates to a louver driving device for an air-conditioner having a main body for intaking and heat-exchanging the air of a room and for furnishing the heat-exchanged air to the room, and louvers for directing the airflow in a given direction.

The inventive louver driving device includes a plurality of human body sensors that monitor the presence of a human body in the room; human body position detecting sections that each receive output signals from the human body sensors, thereby determining a human body's horizontal location from and proximity to the air-conditioner; louver driving sections for operating the louvers so as to direct heat-exchanged air towards the human body; and a microcomputer that receives detection signals from the human body position detecting sections and then sends a control signal to the louver driving sections.

Another aspect of the present invention is a method of controlling the aforementioned louver driving device that includes the steps of detecting the horizontal movement of a human body according to output signals of the sensors; determining the distance between the human body and the air-conditioner according to the output signals of the sensors; and controlling the louvers to direct the heat-exchanged air towards the human body.

DESCRIPTION OF THE PREFERRED EMBODIMENTS

The preferred embodiments of the present invention will now be discussed in detail with reference to the accompanying drawings.

Figure 1:
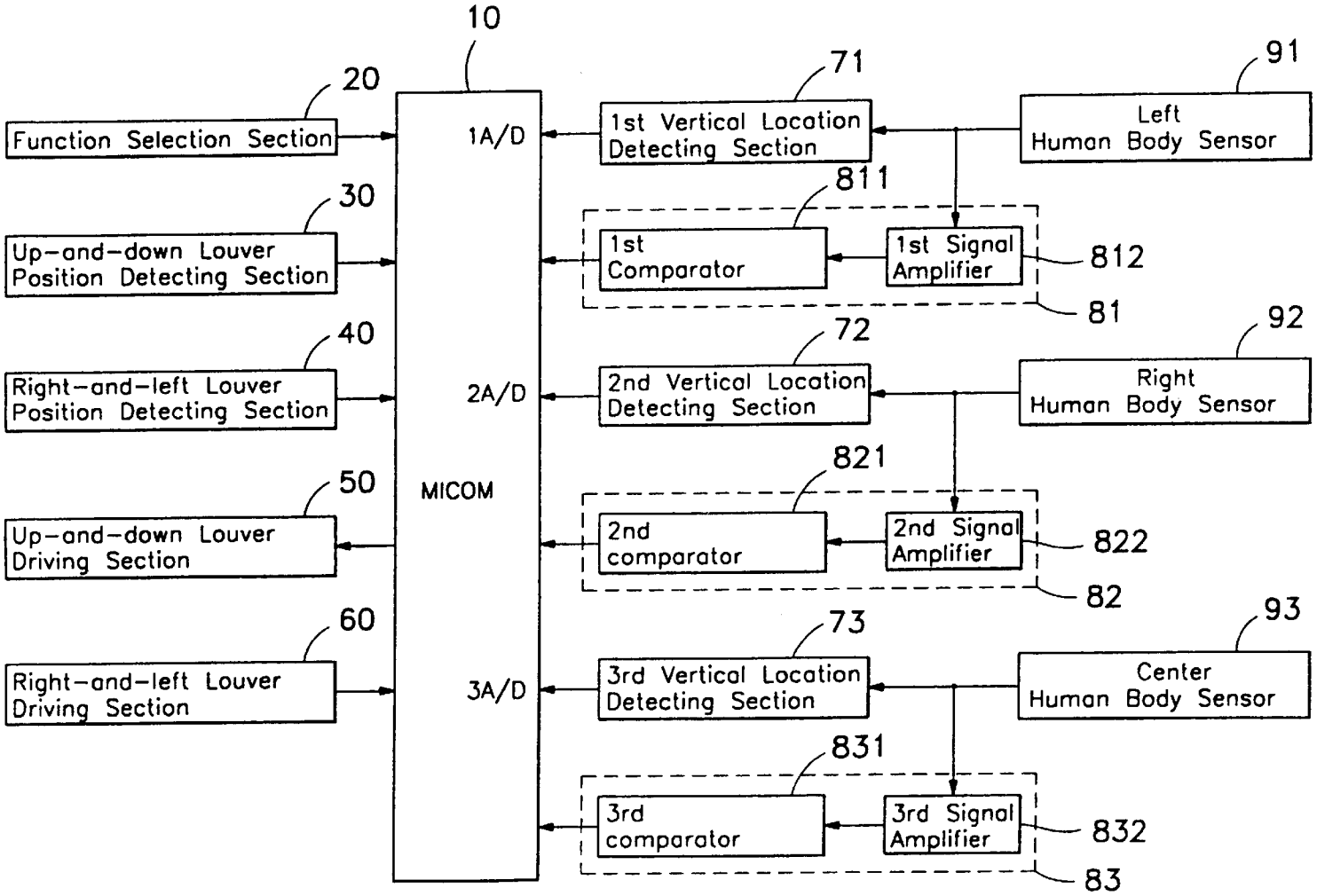
FIG. 1 is a block diagram of a louver driving device for an air-conditioner in accordance with the first preferred embodiment of the present invention.
Figure 2:
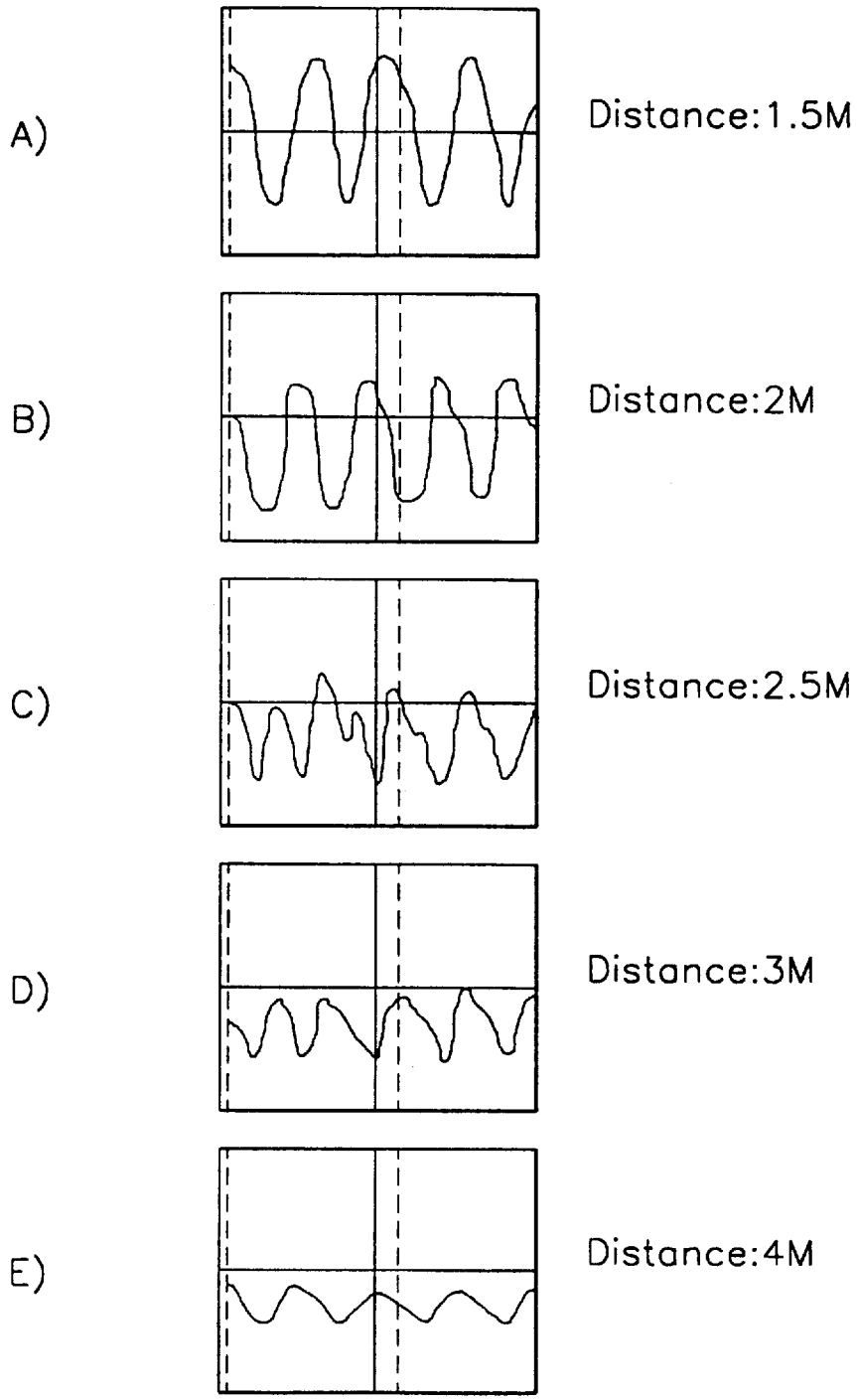
FIGS. 2A to 2E show output waveforms of a proximity in accordance with the preferred embodiment.

FIG. 1 is a block diagram of a louver driving device for an air-conditioner in accordance with the first preferred embodiment of the present invention.

The louver driving device includes a function selection section 20 by which the user selects desired types of air conditioning and airflow; an elevational louver position detecting section 30 for monitoring the current driving position of an elevational louver; a horizontal louver position detecting section 40 for monitoring the current driving position of a horizontal louver; and an elevational louver driving section 50 for driving the elevational louver.

The louver driving device also includes a horizontal louver driving section 60 for driving the horizontal louver. The louver driving device also includes a plurality of human body sensors 91, 92 and 93 for monitoring the presence of a human body in a room by dividing the room into right, left and center zones; vertical location (i.e., distance) detecting (calculating) sections 71, 72 and 73 for detecting the distance of a human body from the air-conditioner on the basis of the outputs of the human body sensors 91, 92 and 93; horizontal location detecting (i.e., zone-detecting) sections 81, 82 and 83 for detecting the horizontal location of a human body in the room on the basis of outputs of the human body sensors 91, 92 and 93; and a microcomputer 10 for sending control signals to the elevational louver driving section 50 and horizontal louver driving section 60 after receiving the output signals of each of the vertical location detecting sections 71, 72 and 73 and horizontal location detecting sections 81, 82 and 83.

The horizontal location detecting sections 81, 82 and 83 each have signal amplifiers 812, 822, 832 that amplify the output signals of the human body sensors to be square-wave signals, and comparators 811, 821 and 831 that each compare the signals amplified by the signal amplifiers 812, 822 and 832 with a preset reference voltage and then send output signals to the microcomputer 10.

Figure 5A:
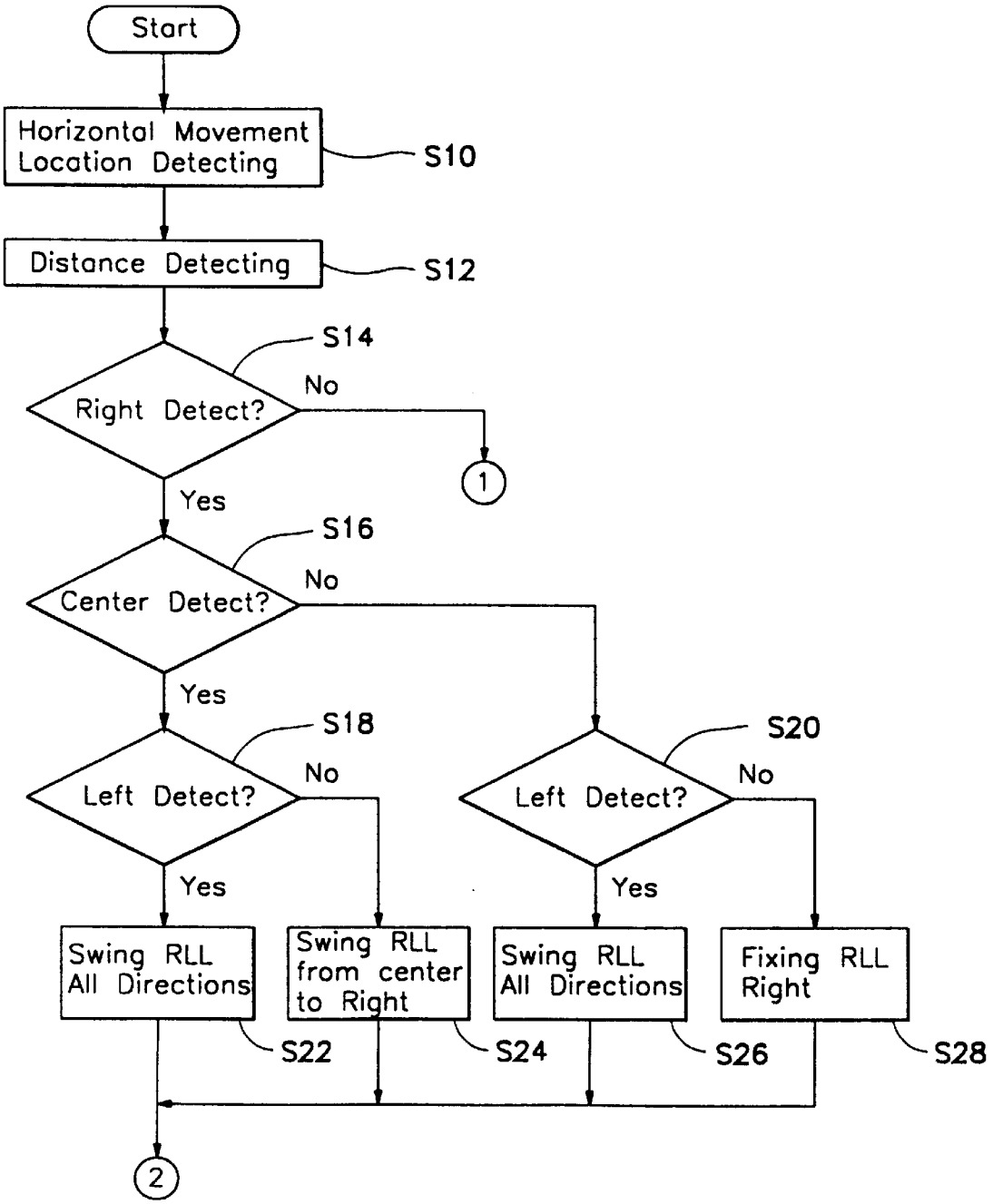
FIGS. 5A and 5B are detailed flowcharts of the control sequence of the louver driving control mechanism of FIG. 4.
Figure 5B:
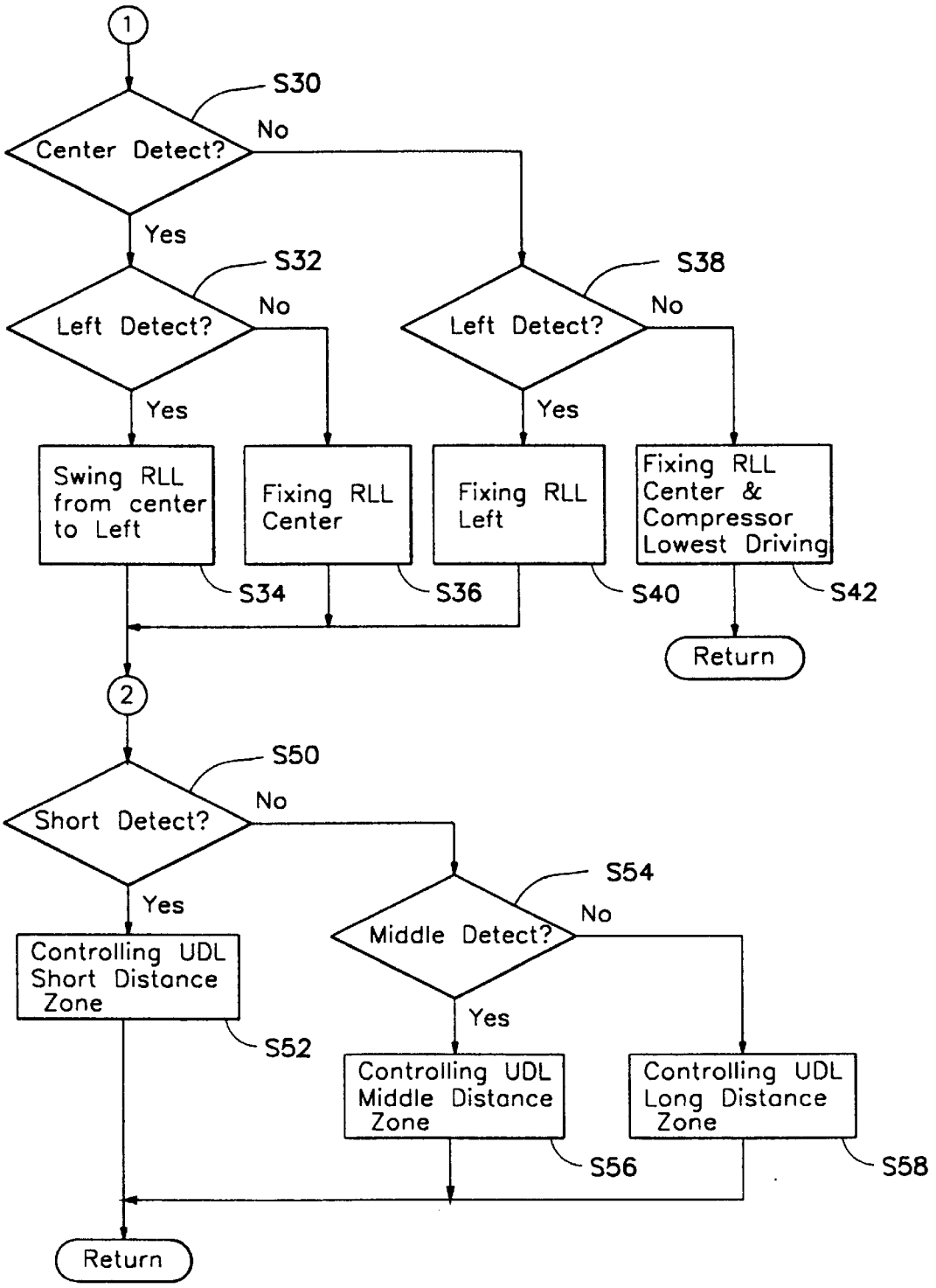
Figure 6:
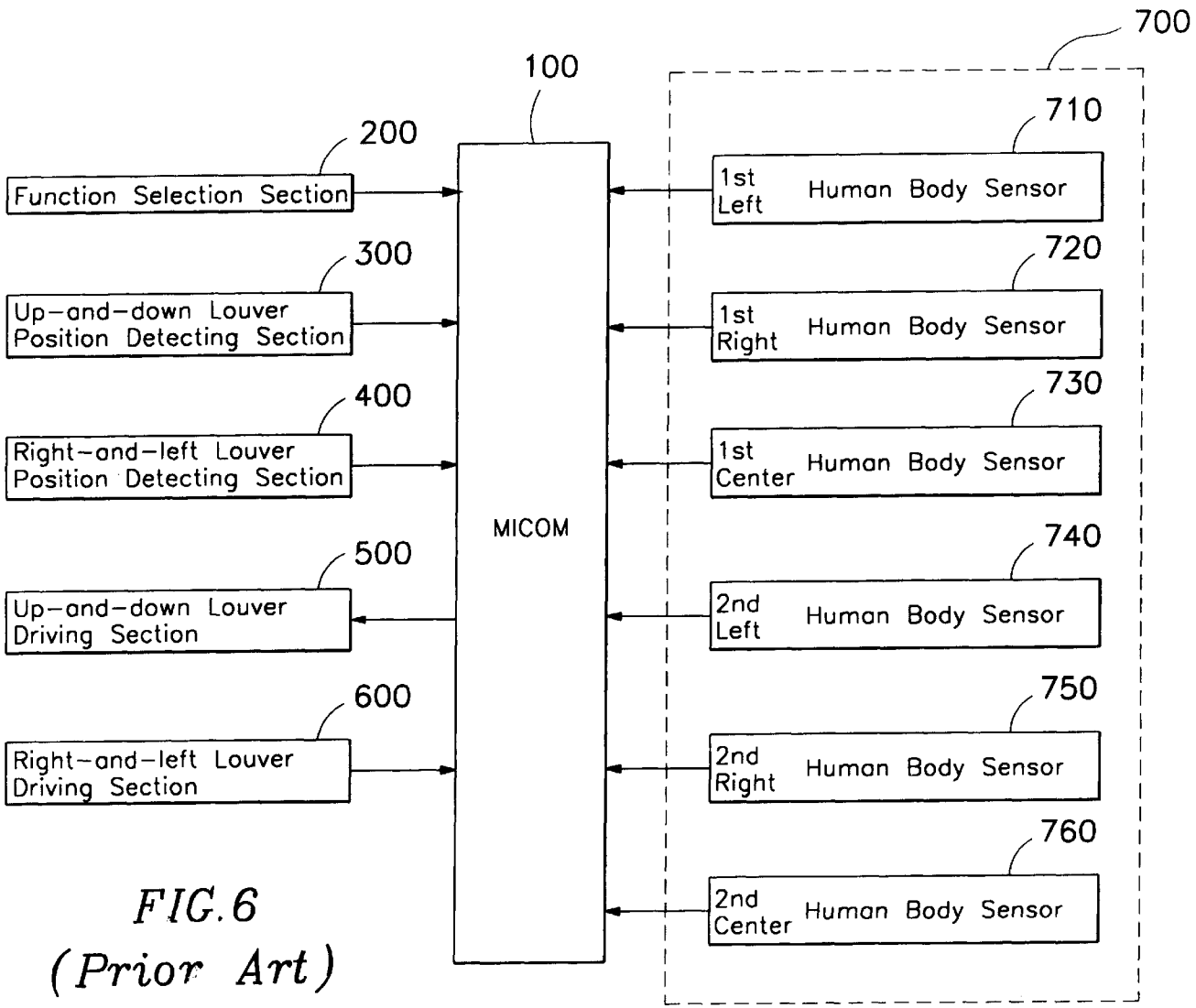
FIG. 6 (Prior Art)
FIG. 6 is a block diagram of a louver driving control device in accordance with a conventional art.
Figure 7:
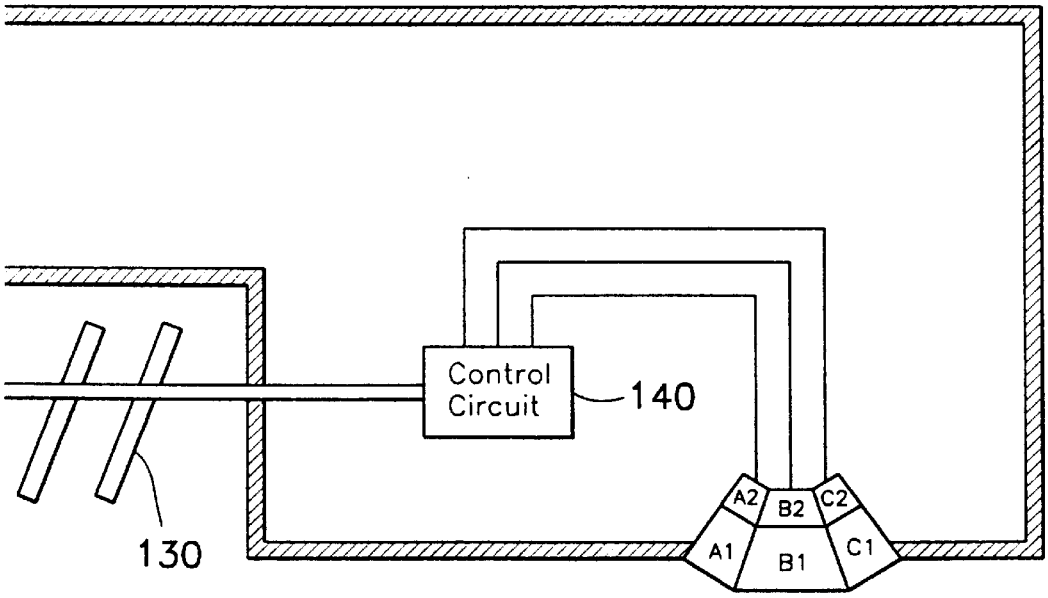
FIG. 7 (Prior Art)
FIG. 7 schematically depicts a conventional air-conditioner' construction.
Figure 8:
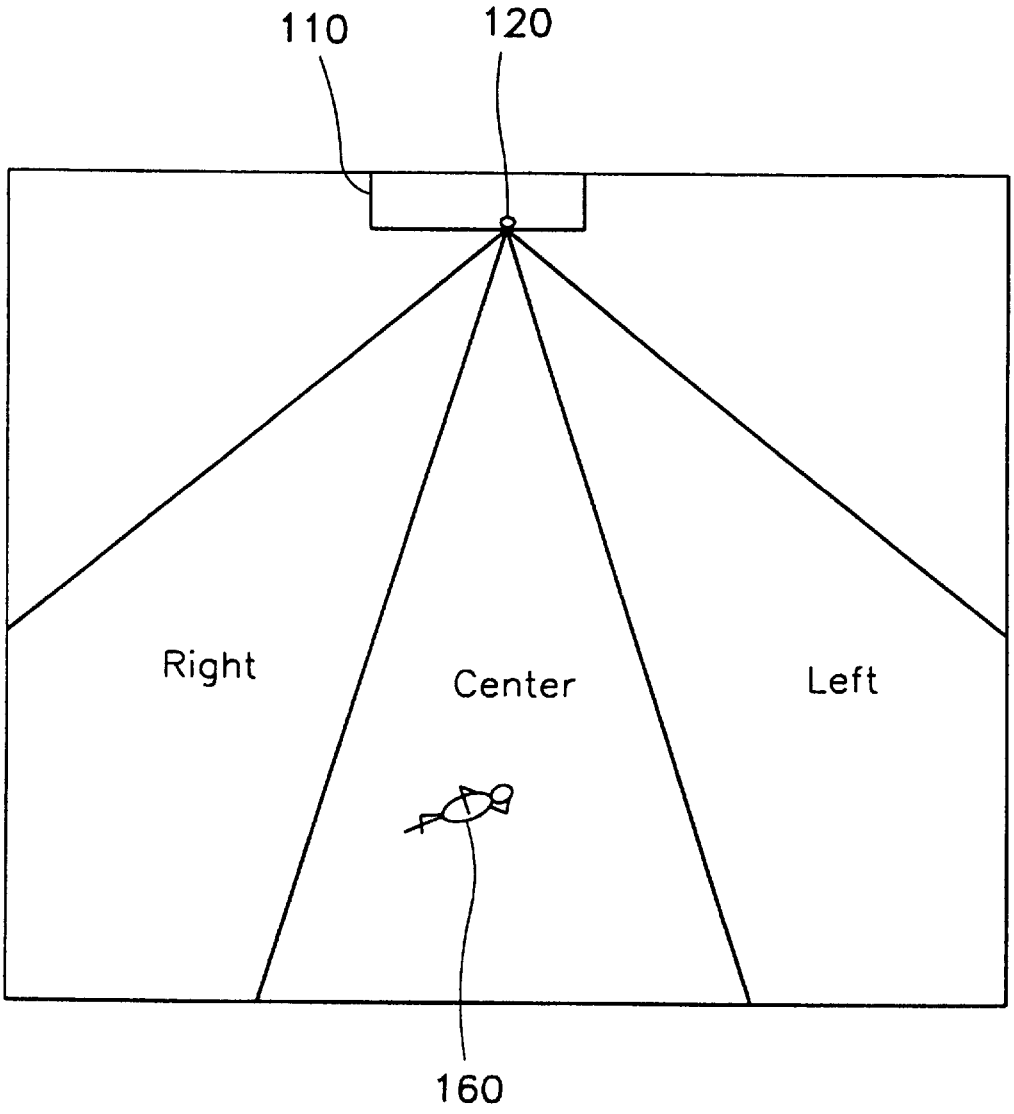
FIG. 8 (Prior Art)
FIG. 8 depicts the detecting zones of a horizontal zone detecting section in accordance with the conventional art.
Figure 9:
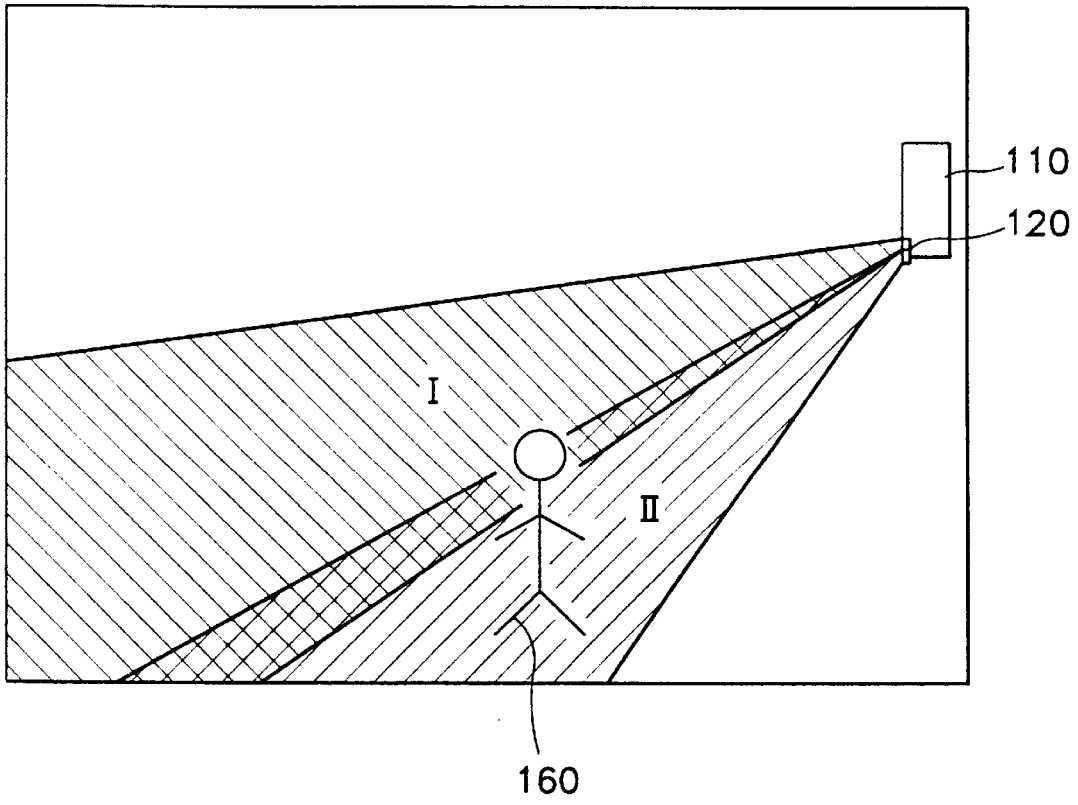
FIG. 9 (Prior Art)
FIG. 9 depicts the detecting zones of a proximity detecting section in accordance with the conventional art.

FIGS. 5A and 5B are detailed flowcharts of the control sequence of the louver driving control mechanism in accordance with the present invention. The louver driving control mechanism includes the steps of detecting (S10) the horizontal location of a human body on the basis of outputs of the human body sensors; detecting (S12) the distance between the human body and the air-conditioner on the basis of outputs of the human body sensors; determining (S14) if a human body is in the right zone of a room to be air conditioned by analyzing the horizontal location and the resultant distance; when the human body is in the right zone of the room, determining (S16) if a human body is also in the center zone; and when the human bodies are in the right zone and center zones, determining (S18) if a human body is also in the left zone.

The louver driving control mechanism also includes the steps of determining (S20) if a human body is in the left zone when a human body is located in the right zone but not in the center zone; swinging (S22) the horizontal louver across the overall horizontal area of the room if the human bodies are present in the right, center and left zones; swinging (S24) the horizontal louver from the center to the right zone if the human bodies are present in the right and center zones but there is no one in the left zone; swinging (S26) the horizontal louver across the overall horizontal area of the room if the human bodies are present in the right and left zones but there is no one in the center zone; setting (S28) the horizontal louver to the right if the human body is in the right zone but there is no one in the center and left zones; determining (S30) if the human body is in the center zone when a human body is not present in the right zone in Step S12; determining (S32) if the human body is in the left zone when a human body is not present in the right zone but in the center zone; swinging (S34) the horizontal louver from the center to the left if human bodies are not present in the right zone but are in the center and left zones; and setting (S36) the horizontal louver to the center if no human body is in the right or left zones but is in the left zone.

The louver driving control mechanism further includes the steps of determining (S38) if a human body is in the left zone of the room when there is no one in its right or center zones; setting (S40) the horizontal louver to the left if there is no one in the right and center zones but a human body is present in the left zone; setting the horizontal louver to the center and completing (S42) the control sequence by operating a compressor at the lowest driving level when there is no one in the right, center and left zones; determining (S50) if a human body is located in a short-distance zone after swinging or setting the horizontal louver to a predetermined direction; setting (S52) the elevational louver to the short-distance zone when a human body is located in the short-distance zone; determining (S54) if a human body is located in the middle-distance zone when the human body is not in the short-distance zone; adjusting (S56) the elevational louver to the middle-distance zone when a human body is located in the middle-distance zone; and if the human body is not in the middle-distance zone, determining that it is located in the long-distance zone, and setting (S58) the elevational louver to the long-distance zone.

The following description relates to the operation of the louver driving device for an air-conditioner and its control mechanism.

Referring to FIG. 1, the desired air conditioning type and the air-conditioner' airflow are selected through the function selection section 20. The elevational louver position detecting section 30 detects the current position of the elevational louver, and the horizontal louver position detecting section 40 detects the current position of the horizontal louver. The elevational louver driving section 50 operates the elevational louver, and the horizontal louver driving section 60 operates the horizontal louver. A plurality of the human body sensors 91, 92 and 93 each monitor the presence of a human body in the right, left or center zone of a room.

The vertical location detecting sections 71, 72 and 73 detect the distance of a human body from the air-conditioner on the basis of outputs of the human body sensors 91, 92 and 93, and the horizontal location detecting sections 81, 82 and 83 detect the horizontal location of a human body on the basis of outputs of the human body sensors 91, 92 and 93.

The horizontal location detecting sections 81, 82 and 83 each include the signal amplifiers 812, 822, 832 for amplifying output signals of the human body sensors to square-wave signals, and the comparators 811, 821 and 831 that each compare these square-wave signals with a preset reference voltage to produce high-level or low-level for the microcomputer 10.

Each of the vertical location detecting sections 71, 72 and 73 serves as an amplifier by amplifying a signal indicative of the distance between a human body and the air-conditioner to a signal of predetermined amplitude. The amplified signal is input to the microcomputer 10 through an analog/digital conversion input terminal 1A/D, 2A/D or 3A/D. The microcomputer 10 detects the amplitude of the signal and its inclination to determine the distance between the air-conditioner and the human body.

FIGS. 2A to 2E show output waveforms of the vertical location detecting sections for an air-conditioner. The longer the distance between the air-conditioner and the human body becomes, the smaller the amplitude and inclination of the analog signal that is applied to the analog/digital conversion input terminal 1A/D, 2A/D or 3A/D become.

Referring to FIG. 1, when the air-conditioner detects the location of a human body, the human body sensors 91, 92 and 93 amplify voltages of the sensor films with two different amplification factors. For detection of a vertical distance, detection signals are each input to the analog/digital conversion input terminal 1A/D, 2A/D and 3A/D of the microcomputer 10. For detection of a horizontal distance, the amplifiers 812, 822 and 832 amplify the signals, and a digital signal is input to the microcomputer 10 through the comparators 811, 821 and 831. The microcomputer 10 detects a human body's horizontal position and vertical distance from the air-conditioner by referring to the signals, and produces a louver driving control signal. The signal amplification factor B of the vertical location detecting sections 71, 72 and 73 is relatively smaller than that (A) of the horizontal location detecting sections 81, 82 and 83 (A>B).

Figure 3:
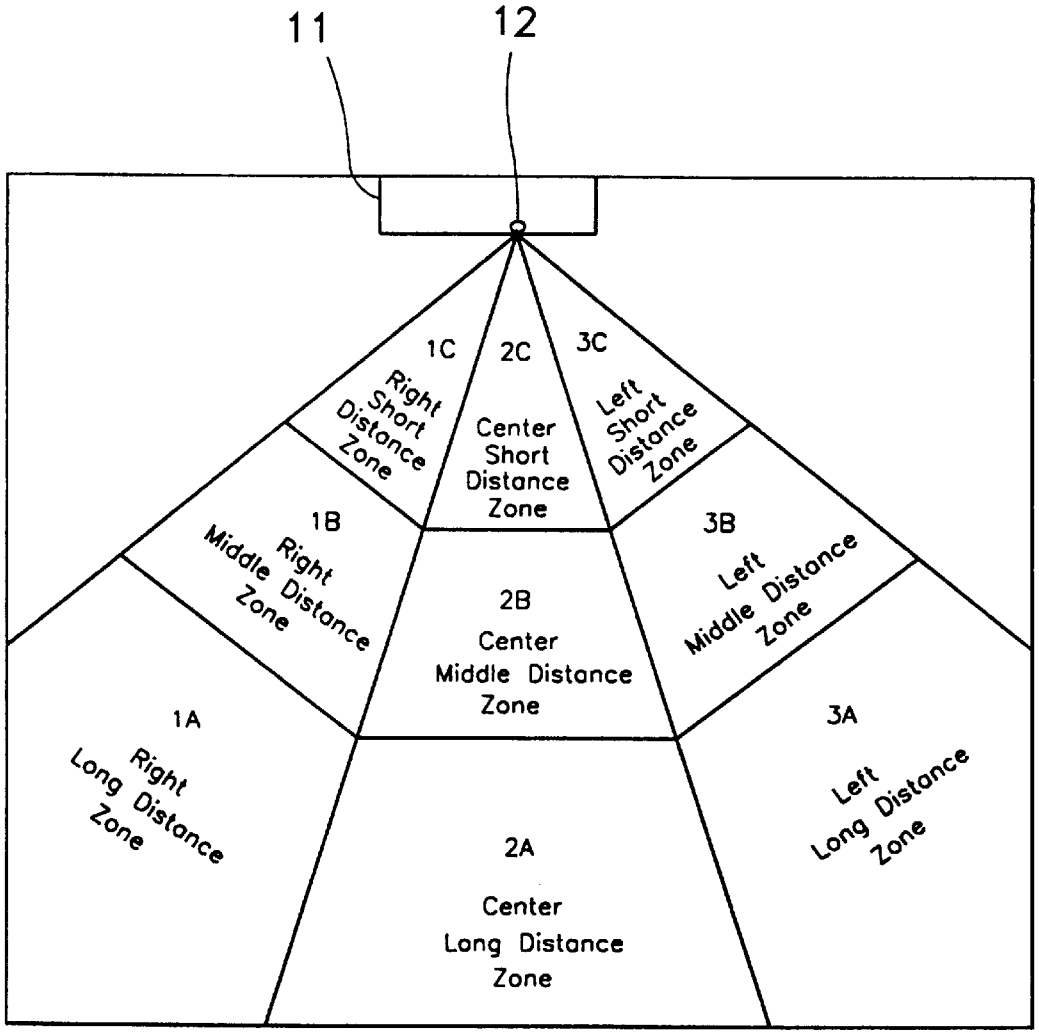
FIG. 3 depicts detecting zones of a human body sensor in accordance with the present invention.
Figure 4:
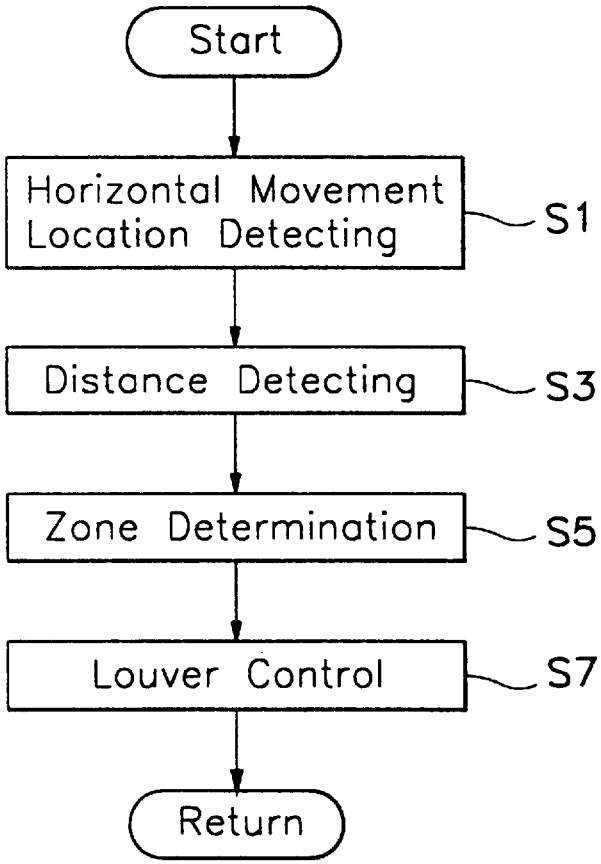
FIG. 4 is a flowchart of the control sequence of the louver driving control mechanism in accordance with the present invention.

FIG. 3 depicts detecting zones of the air-conditioner' human body sensor in accordance with the present invention, and FIGS. 5A and 5B are detailed flowcharts of the control sequence of the louver driving control mechanism for the air-conditioner in accordance with the present invention.

After the desired air conditioning type, temperature and airflow are selected by the user, the microcomputer 10 calculates the difference between the selected temperature and the actual indoor temperature, which is detected by the air-conditioner' temperature sensor, and determines the operation frequency of the compressor. The compressor is driven at the operation frequency under the control of the microcomputer 10 and its function varies with the indoor air conditioning load. The louver operation is controlled simultaneously with the actuation of the compressor in the order shown in FIGS. 5A and 5B. First, a plurality of human body sensors monitor (S10) the current horizontal position of a human body and detect (S12) the distance between the human body and the air-conditioner.

If the human body is in a left middle-distance zone 3B, the human body sensor 91 for detecting the left zone of the room determines that the human body is in the left zone and produces a square-wave signal. In addition, the distance between the human body and the air-conditioner is determined by the horizontal location detecting section according to the human body sensor 91's output. When an output signal of the human body sensor 91 is amplified by the predetermined amplification factor B and input to the analog/digital conversion input terminal, the microcomputer 10 compares it with reference values α and β (α>β). If the analog-digital converted signal is smaller than α but larger than β, the microcomputer 10 determines that the human body is in the middle-distance zone.

After the microcomputer 10 determines (S14) if a human body is located in the right zone by analyzing the result obtained by detecting the horizontal position and distance, it then determines (S16) if a human body is also in the center zone. Since a plurality of human bodies are present in the room, the presence of the human bodies is detected in at least two zones of the room.

If human bodies are detected in the right and center zones of the room, the microcomputer 10 then determines (S18) if a human body is in the left zone. When a human body is in the right zone but not in the center zone, the microcomputer 10 determines (S20) if a human body is present in the left zone of the room.

If human bodies are present in the right, center and left zones of the room, the microcomputer 10 swings (S22) the horizontal louver over the entire horizontal range of the air-conditioner. When the human bodies are in the right and center zones but not in the left zone, it swings (S24) the horizontal louver from the center to the right. When a human body is in the left zone while another human body is located in the right zone not in the middle, the microcomputer 10 swings (S26) the horizontal louver across the entire range of the air-conditioner.

When the human body is in the right zone but not in the center and left zones, the horizontal louver is set to the right (S28) so as to direct the heat-exchanged air to the human body in the right zone.

If the microcomputer 10 detects (S12) that a human body is not in the right zone, it determines (S30) whether or not another human body is located in the center of the room. If there is, it determines (S32) if another human body is in the left zone.

When a human body is not in the right zone but human bodies are in the center and left zones, the microcomputer 10 swings (S34) the horizontal louver from the center to the left. When no human body is in the left and right zones but a human body is in the center zone, the microcomputer 10 sets (S36) the horizontal louver to the middle.

When no human bodies are in the right and center zones of the room, the microcomputer 10 determines (S38) if another human body is in the left zone. When no human bodies are in the right and center zones of the room and a human body is present in the left zone, the microcomputer 10 sets (S40) the horizontal louver to the left.

If no human bodies are in the right, center and left zones of the room, the microcomputer 10 sets the horizontal louver to the middle, and operates (S42) the compressor at the lowest driving level, thereby completing the step. In other words, when no human body is in the room, the microcomputer 10 sets the horizontal louver to the center and presets the operation frequency for the compressor to the lowest level, and as there is no need to operate the compressor, the power consumption can be minimized.

After fixing or swinging the horizontal louver by detecting the horizontal location of a human body, the microcomputer 10 determines (S50) if a human body is in the short-distance zone of the room, and when the human body is in the short-distance zone of the room, it lowers (S52) the elevational louver to the short-distance zone.

When the human body is not in the short-distance zone, the microcomputer 10 determines (S54) if the human body is in the middle-distance zone, and adjusts (S56) the elevational louver to the middle-distance zone. If the human body is not in the middle-distance zone, the microcomputer 10 raises (S58) the elevational louver to the long-distance zone.

According to the inventive louver driving device for an air-conditioner and its control mechanism, the current location of the human body is determined by output signals of the vertical position detecting sections 71, 72 and 73 and horizontal position detecting sections 81, 82 and 83. The operation of each of the elevational louver and the horizontal louver is controlled by the location of the human body so that the heat-exchanged air can be directly provided to the human body. Since the distance between the human body and the air-conditioner is exactly calculated by one human body sensor in each zone, the number of expensive infrared sensors is less than that of the conventional air-conditioner.

As described above, the inventive vertical and horizontal position detecting sections exactly detect the location of the human body, thus allowing the heat-exchanged air to be furnished to users directly and properly. The infrared sensors whose number is relatively smaller than the conventional ones' are employed to monitor detecting zones of a room to be air conditioned, thereby lowering the production costs.

What is claimed is:

1. In an air-conditioner with a main body for intaking and heat-exchanging the indoor air of a room and for discharging the heat-exchanged air into the room, displaceable louvers for varying the discharge direction of the heat-exchanged air in up-and-down/right-and-left/directions, and a louver control mechanism comprising:

human body sensors for detecting the presence of human bodies in respective horizontally adjacent zones of a room, and emitting respective output signals when human bodies are detected;

amplification means connected to each of the human body sensors for amplifying an output signal from a respective human body sensor at first and second amplification factors, to produce from the output signal first and second amplified signals, respectively, the second amplification factor being smaller than the first amplification factor, whereby the first amplified signal has a greater amplification than the second amplified signal;

location determining means for receiving the first amplified signal and comparing the amplitude thereof with a reference value for determining therefrom a location of a human body in a respective zone, and emitting a corresponding human body location signal;

distance determining means for receiving the second amplified signal for determining from an amplitude and inclination thereof, a distance from the air conditioner to a human body in the respective zone, and emitting a corresponding human body distance signal;

a louver driving means connected to the louver for displacing the louvers to vary the discharge direction of heat-exchanged air; and means for receiving the human body location signal and the human body distance signal and for generating on the basis thereof a control signal and supplying the control signal to the louver driving means for directing the heat-exchanged air toward the detected human body.

2. The air conditioner according to claim 1 wherein the sensors consist of three sensors associated with three respective zones.

3. The air conditioner according to claim 2 wherein the human body location signal is a digital signal, and the human body distance signal is an analog signal.

4. The air conditioner according to claim 1 wherein the human body location signal is a digital signal, and the human body distance signal is an analog signal.

5. A method of controlling a discharge direction of heat-exchanged air from an air conditioner, the air conditioner including a main body for intaking and heat exchanging the indoor air of a room, and louvers for discharging the heat-exchanged air back into the room, the louvers being displaceable for controlling the discharge direction of the heat-exchanged air in up-and-down/right-and-left directions, the method comprising the steps of:

A) energizing human body sensors for detecting the presence of human bodies in respectively horizontally adjacent zones of a room, and emitting respective output signals when human bodies are detected;

B) amplifying each of the output signals at first and second amplification factors to produce respective first and second amplified signals from one output signal, the second amplification factor being smaller than the first amplification factor, whereby the first amplified signal has a greater amplification than the second amplified signal;

C) comparing the amplitude of the first amplified signal with a reference value for determining therefrom a location of a human body in a respective zone, and emitting a human body location signal;

D) determining from an amplitude and inclination of the second amplified signal a distance from the air conditioner to a human body in the respective zone, and emitting a human body distance signal;

E) generating, on the basis of the human body location signal and the human body distance signal, a control signal; and F) supplying the control signal to a louver driving device for directing the heat-exchanged air toward the detected human body.

6. The method according to claim 5 wherein step A comprises energizing exactly three human body sensors for detecting the presence of human bodies in three respective zones.

7. The method according to claim 6 wherein step C comprises emitting the human body location signal in the form of a digital signal, and step D comprises emitting the human body distance signal in the form of an analog signal.

8. The method according to claim 5 wherein step C comprises emitting the human body location signal in the form of a digital signal, and step D comprises emitting the human body distance signal in the form of an analog signal.

* * * * *